US006646618B2

(12) United States Patent
Sievenpiper

(10) Patent No.: US 6,646,618 B2
(45) Date of Patent: Nov. 11, 2003

(54) LOW-PROFILE SLOT ANTENNA FOR VEHICULAR COMMUNICATIONS AND METHODS OF MAKING AND DESIGNING SAME

(75) Inventor: Daniel Sievenpiper, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/829,192

(22) Filed: Apr. 10, 2001

(65) Prior Publication Data

US 2003/0174095 A1 Sep. 18, 2003

(51) Int. Cl.[7] ..... H01Q 13/10
(52) U.S. Cl. ..... 343/770; 343/713
(58) Field of Search ..... 343/767, 770, 343/771, 700 MS, 713, 711, 746

(56) References Cited

U.S. PATENT DOCUMENTS

| | | | | | |
|---|---|---|---|---|---|
| 4,051,477 | A | | 9/1977 | Murphy et al. | 343/700 MS |
| 4,242,685 | A | * | 12/1980 | Sanford | 343/770 |
| 4,367,475 | A | | 1/1983 | Schiavone | 343/767 |
| 4,371,877 | A | | 2/1983 | Doussot et al. | 343/770 |
| 4,395,713 | A | * | 7/1983 | Nelson et al. | 343/713 |
| 4,443,802 | A | | 4/1984 | Mayes | 343/729 |
| 4,590,478 | A | | 5/1986 | Powers et al. | 343/700 MS |
| 4,672,386 | A | | 6/1987 | Wood | 343/770 |
| 4,684,953 | A | | 8/1987 | Hall | 343/725 |
| 4,803,494 | A | * | 2/1989 | Norris et al. | 343/770 |
| 4,821,040 | A | | 4/1989 | Johnson et al. | 343/700 MS |
| 4,903,033 | A | | 2/1990 | Tsao et al. | 343/700 MS |
| 4,916,457 | A | | 4/1990 | Foy et al. | 343/770 |
| 4,922,263 | A | | 5/1990 | Dubost et al. | 343/797 |
| 4,958,165 | A | | 9/1990 | Axford et al. | 343/700 |
| 5,287,116 | A | * | 2/1994 | Iwasaki et al. | 343/700 MS |
| 5,406,292 | A | * | 4/1995 | Schnetzer et al. | 343/700 MS |
| 5,581,266 | A | * | 12/1996 | Peng et al. | 343/770 |
| 5,966,096 | A | | 10/1999 | Brachat | 343/700 MS |
| 6,218,997 | B1 | * | 4/2001 | Lindenmeier et al. | 343/725 |
| 6,388,537 | B1 | * | 5/2002 | Matsumoto | 333/21 A |

FOREIGN PATENT DOCUMENTS

| | | | |
|---|---|---|---|
| DE | 41 41 870 A1 | 7/1992 | H01Q/1/32 |
| EP | 0 295 003 | 12/1988 | H01Q/13/18 |
| EP | 0 598 580 A1 | 5/1994 | H01Q/13/10 |
| GB | 1 387 679 | 3/1975 | H01Q/1/20 |
| JP | 63-033905 | 2/1988 | H01Q/13/18 |
| JP | 2000-252739 | 9/2000 | H01Q/13/08 |

OTHER PUBLICATIONS

Abstract of JP 63–033905, *Patent Abstracts of Japan*, vol. 012, No. 246 (Jul. 12, 1988).

Abstract of JP 2000–252739, *Patent Abstracts of Japan*, vol. 2000, No. 12 (Jan. 3, 2001).

Balanis, C. A., *Antenna Theory: Analysis and Design*, 2nd Edition, pp. 760–762 (1997).

Chen, W.–S., et al., "Compact Circularly–Polarized Circular Microstrip Antenna with Cross–Slot and Peripheral Cuts," *Electronics Letters*, vol. 34, No. 11, pp. 1040–1041 (May 28, 1998).

Johnsson, R.C., *Antenna Engineering Handbook*, 3rd Edition, pp. 8.7–8.9 (Nov. 8, 1999).

Lu, J.–H., et al., "Single–Feed Circularly Polarized Equilateral–Triangular Microstrip Antenna with a Tuning Stub," *IEEE Transactions on Antennas and Propagation*, vol. 48, No. 12, pp. 1869–1872 (Dec. 2000).

* cited by examiner

*Primary Examiner*—Hoang Nguyen
(74) *Attorney, Agent, or Firm*—Ladas & Parry

(57) ABSTRACT

A crossed slot antenna, a method of fabricating same and a method of designing same. The antenna includes a cavity structure having conductive material on opposed surfaces thereof; and two slots in said conductive material, the slots having slightly different lengths and intersecting each other at or close to a 90 degree angle.

64 Claims, 8 Drawing Sheets

LOW-PROFILE SLOT ANTENNA FOR VEHICULAR COMMUNICATIONS AND METHODS OF MAKING AND DESIGNING SAME

TECHNICAL FIELD

This invention relates to an antenna that is capable of communicating with both a satellite system and a terrestrial system simultaneously. For example, the antenna may be conveniently used to receive signals broadcast by a direct broadcast satellite radio system or other high altitude broadcast system, in which radio or other signals signals are broadcast directly from one or more satellites to mobile vehicles on or near the ground and are also received by terrestrial repeaters, and then rebroadcast terrestrially to the mobile vehicles on or near the ground.

BACKGROUND OF THE INVENTION

Satellite-based direct broadcast systems are currently used to broadcast TV and radio signals to fixed ground stations which typically use a dish-shaped antenna to receive the signals. These systems have become very popular and soon this direct broadcast satellite technology is moving into the vehicular field. Vehicles pose a number of interesting challenges for this technology. First, in the case of terrestrial vehicles which can move on or near the surface of the earth, their movement means that the satellite signal will be occasionally blocked due to natural and man-made obstructions near which the vehicles travel. Since the satellite signals can be blocked by obstructions such as buildings and mountains, it has been proposed to transmit a second signal terrestrially which is locally provided by a repeater located to receive the satellite or high altitude broadcast signals without interference. See FIG. 1. The direct broadcast satellite signals will arrive at the vehicle 1 with circular polarization from a location possibly high above the horizon due to the altitude of satellite 2. In contrast, the repeated signals will arrive with vertical polarization from a repeater location 3 frequently near the horizon. Services which will be using such technology include possibly XM Radio and Sirius Radio. The entire frequency range allocated for XM Radio is 2.3325 to 2.345 GHz, and the entire frequency range allocated for Sirius Radio is 2.320 to 2.3325 GHz. This includes the satellite signal as well as the terrestrial signals from the repeaters. The total bandwidth required is much less than the bandwidth of the antenna disclosed herein.

Using conventional antenna technology, the antennas on a vehicle 1 to receive such signals would tend to be (i) numerous, (ii) unsightly and/or non-aerodynamic, (iii) possibly expensive, and (iv) would be difficult to point properly.

Similarly, as demand for existing wireless services grows and other new services continue to emerge, there will be an increasing need for still more antennas on vehicles. Existing antenna technology usually involves monopole or whip antennas that protrude from the surface of the vehicle. These antennas are typically narrow band, so to address a wide variety of communication systems, it is necessary to have numerous antennas positioned at various locations around the vehicle or to complicate the antenna design by making them multiband antennas. Furthermore, as data rates continue to increase, especially with 3G, Bluetooth, direct satellite radio broadcast, wireless Internet, and other such services, the need for antenna diversity will increase. This means that, if conventional antenna technology is followed, each individual vehicle would require multiple antennas each operating in different frequency bands, and/or with different polarizations and sensitive at different elevations relative to the horizon. Since vehicle design often dictated by styling, the presence of numerous protruding antennas will not be easily tolerated.

With the increasing number of wireless data access systems that will be incorporated into future vehicles, the number of antennas is also apt to increase. Many of these new data access systems will involve communication with a terrestrial network and also with a satellite or other high altitude transmitter. One such system is the previously mentioned direct broadcast satellite radio which will soon be operational. Transmitting systems aboard satellites typically broadcast in circular polarization so that the receiving mobile vehicle can be in any orientation with respect to the satellite, without the need to orient the vehicle's antenna. However, terrestrial broadcast systems typically use linear polarization for multi-path reasons, with vertical polarization being preferred for moving receiving stations for reasons well known in the art. Hence there is a need for antennas which can receive both circular polarization from the sky as well as vertical linear polarization near the horizon. These antennas exist, with the most common example being the helix antenna. One disadvantage of the helix antenna is that it protrudes one-quarter to one-half wavelength from the surface of the vehicle. Since current direct broadcast radio systems operate at 2.34 GHz, this results in an antenna that is several centimeters tall. The presence of an unsightly vertical antenna and/or a plurality of antennas, is often unacceptable from a vehicle styling point of view. Additionally, such antennas increase the aerodynamic drag of the automobile which is undesirable for energy-conservation reasons.

As a consequence, there is a need for an antenna that can perform as well as the vertical helix antenna, but has a low profile so that it can easily be adapted to conform to the roof over the passenger compartment of a vehicle, for example. The antenna should preferably be simple to manufacture using common materials. The antenna should be capable of receiving signals having circular polarization from orbiting satellites as well as signals having vertical linear polarization from terrestrial stations or repeaters.

In the design of antennas for low-angle radiation, one must consider each section of the radiating aperture and how it contributes to the overall radiation pattern. If one restricts the antenna design to one having a low-profile (for example, an antenna having a thickness much less than a quarter wavelength), there are only a few fundamental elements available. The most common low-profile antenna is the patch antenna, which is shown in FIG. 2. The patch antenna consists of a metal shape 10 supported above a ground plane 12 and fed by a coaxial probe or other feed structure 14. While the patch is a common low-profile antenna element, it is a poor choice for receiving (or transmitting) radiation at low angles. The reason for this is that the two edges 10-1, 10-2 of the patch 10 both radiate and the interference between the two determines the overall radiation pattern of the antenna. In the direction normal to the ground plane 12, the interference is constructive and the patch 10 provides significant gain in that direction. However, in a direction toward the horizon (e.g. in a direction parallel to the ground plane 12), the interference is destructive, and the patch produces very little radiation in that direction. One way to avoid this problem is to bring the two edges 10-1, 10-2 of the patch closer together. However the effective overall length must remain one-half wavelength, so this requires that the patch be loaded with a high dielectric material. Furthermore due to the difficulties of achieving very high dielectric materials, there is a limit to how small a patch can be. Moreover, as the patch size is reduced, its bandwidth is also reduced.

FEATURES OF THE PRESENT INVENTION

A unique feature of the preferred embodiments of antenna disclosed herein is that it can receive both circularly polarized signals from a satellite in the sky as well as vertical linearly polarized signals from a terrestrial repeater. For the purpose of this specification and the claims herein, the term "satellite" is defined to mean an object which is in orbit about a second object or which is at a sufficiently high altitude above the second object to be considered to be at least airborne and "terrestrial" or "earth" is defined to mean on or near the surface of the second object.

An advantage of the present invention is it can achieve these properties with a form factor that is much thinner than one-quarter wavelength in height, and only slightly larger than one-half wavelength square in area. Indeed, the height of the antenna is preferably under 5% of a wavelength.

Since the antenna form factor is very important to vehicle designers, the small package permitted by this antenna is preferable to other competing designs which typically involve protruding antenna elements that are one-quarter wavelength in height or taller. For upcoming direct broadcast satellite radio systems, this translates into an antenna height of several millimeters (mm) for the antenna disclosed herein compared to several centimeters for competing designs.

The most significant antenna problem for a direct broadcast satellite signal receiving system as shown by FIG. 1 is communicating with a terrestrial network, because this involves receiving radiation from low angles, across the metal roof of a vehicle, in addition to receiving signals directly from satellites. Typically this requires that the antenna have significant height, or that it be elevated above the ground plane. The present antenna achieves this unique form factor by utilizing a slot antenna which has a good fundamental geometry for receiving at low angles. This is because a single slot antenna has only one radiating aperture, which is the thinnest possible aperture for a given wavelength. Furthermore, a slot antenna generates the greatest currents in the surrounding ground plane which are responsible for radiation to low angles.

The preferred embodiments of the present antenna involve a crossed pair of slots which are slightly detuned from one another in order to generate circular polarization for satellite reception. Thus, this antenna achieves good performance for both satellite reception and terrestrial reception, in a very thin design.

The present invention also provides a unique feed geometry, which allows the antenna to be fed at only one location, and represents a significant improvement over existing designs. Optionally it includes a radome structure, and the capability for active electronics such as amplifiers to be included in the antenna package.

The antenna described below achieves these features and other in a volume that is only a few millimeters tall. While the specific embodiment of this antenna discussed below is specifically designed for a direct broadcast satellite radio system, it can also be applied to other systems involving communication with both a satellite and a terrestrial network.

BRIEF DESCRIPTION OF THE INVENTION

In one aspect, the present invention provides a crossed slot antenna having a resonance frequency, the antenna comprising an electrically conductive structure defining a cavity therein; first and second slots formed in the electrically conductive structure, the slots having different lengths such that one slot has a resonance frequency above the center frequency of the antenna and such that the second slot has a resonance frequency below the center frequency of the antenna; and a common feed point which is arranged to couple the radio frequency signal from the slots to said common feed point.

In another aspect, the present invention provides a method of fabricating a crossed slot antenna comprising the steps of: (a) forming a cavity using a printed circuit board plated with metal on opposed surfaces; (b) etching two slots in the plated metal, the slots having slightly different lengths and intersecting each other at a 90 degree angle; and (c) forming a metal plated via in said printed circuit board, said metal plated via defining a common feed point for the slots.

In still another aspect, the present invention provides a method of fabricating a crossed slot antenna comprising: (a) forming a cavity structure having conductive material on opposed surfaces thereof; and (b) etching two slots in the conductive material, the slots having slightly different lengths and intersecting each other at approximately a 90 degree angle.

In another aspect, the present invention provides a crossed slot antenna comprising: (a) a cavity structure having conductive material on or forming opposed surfaces thereof; and (b) two slots in the conductive material, the slots having slightly different lengths and intersecting each other at or close to a 90 degree angle.

The present invention, in yet another aspect, provides a slot antenna having: (a) a cavity structure having conductive material on or forming opposed surfaces thereof; (b) at least one slot in the conductive material on a first surface of the cavity structure; and (c) a feed point for the slot, the feed point being disposed in and penetrating the cavity structure, the feed point being coupled to the first surface at a point thereon which is spaced from the slot.

In still yet another aspect, the present invention provides an antenna unit for mounting on a vehicle, the antenna unit comprising: (a) a support surface and a mounting device for mounting the antenna unit on the vehicle; (b) an antenna adapted for receiving circularly polarized radio frequency signals in at least directions oblique to the support surface; and (c) a protective cover for the antenna.

The present invention, in yet another aspect, provides a method of receiving circularly polarized radio frequency signals comprising the steps of: (a) providing a slot antenna having two slots which cross each other in a surface of a cavity structure; (d) varying the lengths of the slots so that the slots have different individual resonance frequencies; and (c) providing an antenna feed point on the surface which is spaced from both of the slots.

In a different aspect, the present invention also provides a method of designing a crossed slot antenna capable of receiving both circularly polarized radio frequency signals and linearly polarized radio frequency signals, the crossed slot antenna having a pair of crossed slots formed in a surface of a cavity structure. The method comprises the steps of:

(a) calculating an effective dielectric constant in the slots of the crossed slot antenna that is the average of dielectric constant of the cavity and that of any radome or other environment located above the slots;

(b) calculating an effective index of refraction n, where $n=\sqrt{\in_{\text{average}}}$ and where $\in_{average}$=the dielectric constant calculated in step (a);

(c) determining an initially calculated average length of the slots of $\lambda/2n$ where $\lambda$=the wavelength of a desired resonance frequency of the crossed slot antenna;

(d) calculating an inherent bandwidth of crossed slot antenna based on the formula $6\pi V/\lambda^3$ where V=the volume of the cavity structure;

(e) determining an initially calculated length of each slot by adding, for one slot, and subtracting, for the other slot, a distance equal to one-half of the inherent bandwidth, expressed as a percentage, of the antenna;

(f) adjusting the initially calculated length of each slot by experiment.

DETAILED DESCRIPTION OF THE PREFERRED EMBODIMENTS

Figure 2:
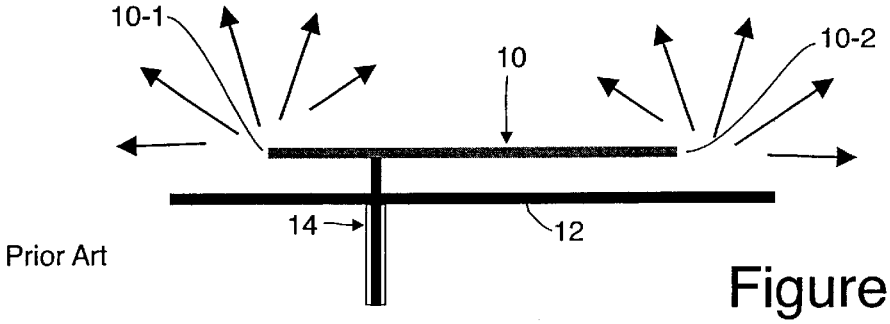
FIG. 2 is a cross-section view of a patch antenna.
Figure 3:
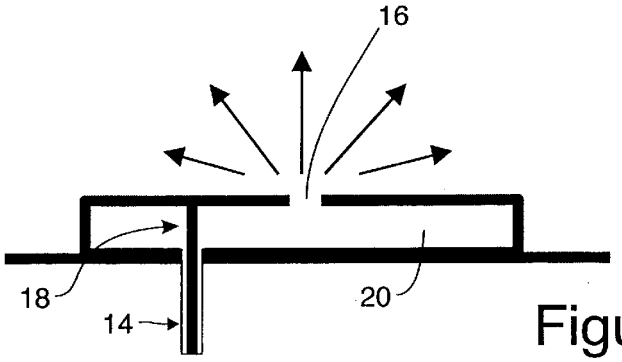
FIG. 3 is a cross section view of a slot antenna with a new feed structure.

FIG. 3 is a cross sectional view of a slot antenna. The slot antenna shown in FIG. 3 has only a single radiating edge 16 in a given linear direction. This provides much greater radiation to low angles because there is no second edge in the same linear direction to create destructive interference. From one viewpoint, the radiation is diffracting through the aperture of the antenna, and the narrowest possible aperture will provide the broadest possible diffraction pattern. From a surface wave viewpoint, the currents in the slot antenna exist only in the surrounding ground plane. Hence, this antenna should have the greatest possible coupling to surface waves that can then radiate away from the antenna at low angles. FIG. 3 also shows a coaxial cable 14 probe feed 18; however this is not conventional for slot antennas and embodies one aspect of this invention. Another advantage of the slot antenna is that it contains a resonant cavity 20 that surrounds the backside of the antenna. In general, the bandwidth of this antenna will be determined by the volume of this cavity 20, which does not need to contain a high dielectric material as does the patch antenna of FIG. 2. Indeed, air would suffice as the dielectric material. However, the preferred dielectric material is a material which can function as a printed circuit board, since that choice simplifies the manufacture of the antenna.

Another advantage of the cavity is that it directs all of the radiation toward the hemisphere above the vehicle and prevents radiation from radiating into the vehicle, while allowing the antenna to sit directly on the metal roof 90 (see FIG. 7*c*) of the vehicle.

Figure 4A:
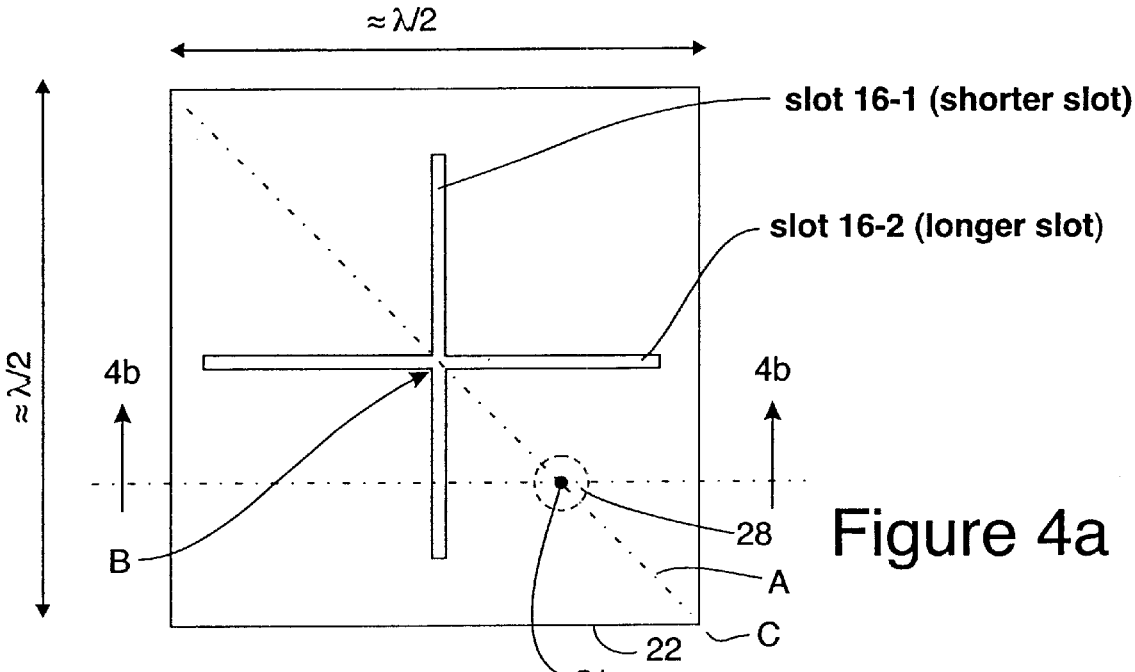
FIG. 4*a* is a plan view of a crossed slot antenna with the new feed structure.
Figure 4B:
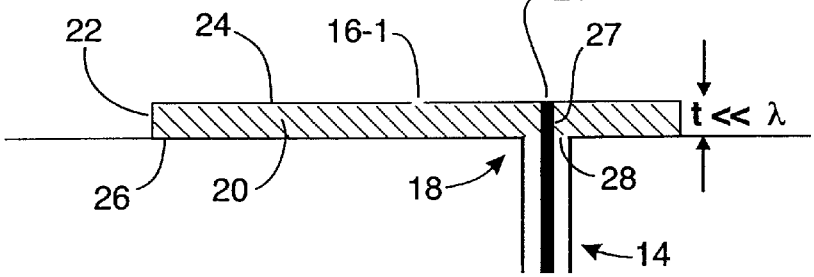
FIG. 4*b* is a cross section view through the crossed slot antenna of FIG. 4*a* taken line 4*b;*

The slot antenna performs well at radiating toward low angles in vertical linear polarization along the E-plane of the antenna. In order to receive (or to generate) circularly polarized RF radiation towards the sky while enjoying a similar antenna gain for vertical linear polarization toward the horizon, the slot antenna is provided with two orthogonal slots 16-1 and 16-2, as is shown in FIGS. 4*a* and 4*b*. The two orthogonal slots 16-1, 16-2 are tuned to slightly different frequencies and cross each other at a 90 degree angle. Also, the two slots 16-1 and 16-2 are centered on each other. Because the slots resonate at slightly different frequencies, they experience a phase shift with respect to one another when driven between their two resonant frequencies. This phase shift is chosen to be 90 degrees for the generation of circular polarization, and is determined by the relative lengths of the two slots. They are driven by a single offset probe feed at point 21, which passes through the cavity 20 at point 21 along (or close to) a line A which is rotated 45 degrees from each of the two slots 16-1 and 16-2. The input impedance may be adjusted by varying the feed point along line A. Feeding the antenna closer to a comer C on the peripheral edge 22 of the cavity 20 will result in a lower input impedance, while feeding it nearer the center B of the cavity 20 will result in a greater input impedance. For a Teflon (poly tetra fluoro ethelene having a dielectric constant of 2.2) filled cavity 20, a feed point 21 that is located one-quarter of the way from the comer C of the cavity 20 results in an input impedance that is close to 50 ohms.

The cavity structure 22, 24 can be built using printed circuit board technology. In such an embodiment, the offset feed point 21 is preferably formed by plating a via 27 and the ground plane 26 on the back side of the cavity is preferably etched away to expose an annular region 28 of the dielectric material in the cavity. While a coaxial cable 14 is depicted as directly coupling to the plated via 27 and with the shield of the coaxial cable 14 being connected to the ground plane adjacent the annular opening around the annular region 28, in a preferred embodiment, the feed point 21 is connected to circuity on another circuit board.

The cavity 20 is depicted as being square-shaped in plan view in FIG. 4*a*; however, the shape of cavity 20 is not important as other shapes are possible including circles, diamonds, or anything in between. The single offset feed point 21 is an important aspect of this invention, as well as its combination with a pair of orthogonal, slightly detuned slots 16-1, 16-2 for the generation and/or reception of circular radio frequency polarization. Another important aspect of this invention is the use of such a crossed slot 16-1, 16-2 antenna for the reception of both circular polarization from above and vertical linear polarization from the horizon. In such a case the major plane of the antenna is oriented to be (ideally) parallel to the major surface of the roof or other upward facing surface of a vehicle carrying the antenna. The major plane of the antenna is thereby typically oriented parallel or nearly parallel to the terrestrial surface most of the time as the vehicle moves about on or near the terrestrial surface.

One specific embodiment of a crossed slot antenna of the present invention is an antenna designed to operate at 2.34 GHz. The cavity 20 of this specific embodiment has a square shape in plan view and provided by a metal cavity 22, 24 filled with a material, preferably Teflon which has a dielectric constant of 2.2. The cavity depth t is 3.175 mm (inside thickness, not including the metal cover 24) and the cavity measures 63 mm on each edge. The two orthogonal slots 16-1 and 16-2 formed in the top surface 24 of the cavity 20 are 51 mm and 54 mm long, respectively, and the feed point 21 is offset from the center B of the cavity 20 by 17 mm along the directions of both slots. The slots are 1 mm wide in this specific embodiment. The width of the slots is not as important as some of the other dimensions, such as the lengths of the slots, which is the most critical dimension. The metal 22, 24 forming the exterior of the cavity 20 is preferably about 50 microns thick (the actual thickness is not critical). Copper is the preferred metal of the cavity 20 because of its high electrical conductivity. Often the copper is coated with gold or tin (depending on the cost allowed) to provide corrosion protection and solderability. For our experimental results reported herein, bare copper was used for the cavity 20. This specific embodiment provided an operating frequency of 2.34 GHz, and a bandwidth of about 10% which is wider than needed for the direct broadcast satellite services previously mentioned. This specific embodiment was tested to produce the data plots discussed below with reference to FIGS. 5 and 6; however, this data and this specific embodiment it is provided for the purposes of example only. In general, the cavity 20 size and shape may be changed. The lengths of the slots 16-1, 16-2 can be tuned as is described below.

For the frequency of interest of 2.34 Ghz, the wavelength $\lambda$ is equal to 128 mm. Since the thickness t of the slot antenna of this specific embodiment is only 3.175 mm, that means that the height of the slots above the ground plane 26 is only about 2.5% of a wavelength $\lambda$ at the frequency at which this antenna operates. If desired, the crossed slot antenna can be thicker or thinner depending on the desired bandwidth of the antenna.

The bandwidth of the antenna can be made arbitrarily narrow by making the cavity 20 thinner, but for a practical antenna there must be some allowance for manufacturing errors, so it is unwise to use an antenna with very narrow bandwidth even if the application does not require that much bandwidth, such as is the case with direct broadcast satellite radio services discussed above. Thus, the cavity 20 may well be thicker than needed for a particular application.

Assuming a bandwidth equal to about 12% of the frequency of interest and an operating frequency of 2.34 GHz, the height of the slots above the ground plane is only about 2.5% of one wavelength $\lambda$ at that frequency. As a result, the crossed slot antenna of the present invention can be quite thin and still have a reasonably wide bandwidth. Crossed slot antennas having thicknesses less than 2.5% a wavelength $\lambda$ of the frequency at which the antenna operates are very realistic. Given the fact that a prior art antenna might be 25% of a wavelength $\lambda$ high, this crossed-slot antenna provides a significant improvement of about an order of magnitude in antenna height reduction (at this frequency of 2.34 GHz) and additionally provides sensitivity to both circular and linear radio frequency signal polarizations for communication with both satellites and terrestrial stations.

The following steps may be used as a guideline for the design of a crossed slot antenna. Since roughly half of the electric field in the slot exists inside the cavity 20, the effective dielectric constant in the slot is the average of that of the cavity 20 and that of any radome 120 or other environment located above the slots (see FIG. 7*c*). For the case of no radome, or a large hollow radome, the dielectric constant of the adjacent environment is equal to 1 and thus the effective index of refraction is then $n=\sqrt{(\in+1)/2}$ where $\in$=the dielectric constant of the material in the cavity 20. The slots 16-1 and 16-2 should then have an average length of $\lambda/2n$. For the specific embodiment discussed above where the crossed slot antenna operates at a frequency of 2.34 GHz, this average length is about 51 mm. One slot should be slightly shorter than this average value (so that it is tuned to a frequency slightly above 2.34 Ghz in this specific embodiment) and the other should be slightly longer (so that it is tuned to a frequency slightly below 2.34 GHz in this specific embodiment). The lengths of the two slots 16-1 and 16-2 should differ by approximately one-half of the inherent bandwidth (expressed as a percentage) of the antenna. The inherent bandwidth of the antenna is determined by the cavity volume, V. The bandwidth of a cavity-backed slot antenna is roughly $6\pi V/\lambda^3$, which is equal to $3\pi t/2\lambda$ for a square cavity having sides with a length of roughly one-half a wavelength ($\approx\lambda/2$) for the frequency of interest and having a thickness t. For the described specific embodiment, this gives a bandwidth of about 12%. Thus, the two slots 16-1, 16-2 should differ in length by about 6%, or about 3 mm. Based on this analysis, one would be lead to specify slot lengths of 51+1.5 or 52.5 mm and 51−1.5 or 49.5 mm. Some fine-tuning may be required, and empirically it was determined that slot lengths of 51 mm and 54 mm seem to work well for this specific embodiment of an antenna resonant at 2.34 GHz. The described procedure for calculating the slot lengths is not exact, but experimental testing to fine tune the antenna typically produces results which differ from the calculated values by only a few percent. As such, this procedure provides a useful guide for determining starting points for lengths of the slots for the crossed slot antenna described herein. The starting points are then adjusted by experiment. The location of the feed point and the other parameters can similarly be adjusted by experiment.

For the case of a circular cavity, or a cavity having another shape, the volume should be maintained roughly the same as the square case. In any event, the feed point 21 should be preferably located on (or very close to—see the discussion below) a line A that is at 45 degrees to both of the slots 16-1, 16-2. The input impedance may be adjusted by varying the position of the feed point 21 along line A. Feed points near the peripheral edge 22 of the cavity will have lower input impedance and feed points near the center B of the cavity will have higher input impedance. The optimum location may be determined by experiment, but a distance roughly one-quarter cavity length from the edge on line A was found to be acceptable for the specific embodiment described above. If the feed point is located off line A, then it is believed that the two slots would usually have different input impedances which might be undesirable in most applications. However, the feed point 21 might be placed off the 45 degree line A slightly to obtain a better input impedance consistency between the two slots 16-1 and 16-2 in recognition of the fact that they have slightly different lengths and therefore the feed point might be located slightly different distances from the respective slots in compensation therefore. Thus the feed point 21 might be located close to line A but displaced off it slightly to provide a better input impedance match to both antennas.

The width of a slot 16 is much thinner than its length, but the absolute width is not very important. In the specific embodiment disclosed, the width was arbitrarily selected to be 1 mm, a dimension which seemed to work well.

Antennas with the described crossed slots 16-1 and 16-2 produce circular polarization because the lengths of the two slots are slightly different and thus the two slots have slightly different resonance frequencies. If the slots are driven (either by a transmitted signal or by a received signal) between their two resonance frequencies, then one slot will slightly lead the applied signal, and the other slot will slightly lag the applied signal, depending on the frequency of the applied signal with respect to the natural resonance frequency of each antenna slot. In this antenna design, the lengths of each antenna slot 16-1 and 16-2 are selected so that the phase difference produced by this lead and lag is preferably exactly 90 degrees total, thereby radiating (or receiving) circular polarization. If the phase difference is not exactly 90 degrees, then the antenna will not have exactly true circular polarization.

Figure 5:
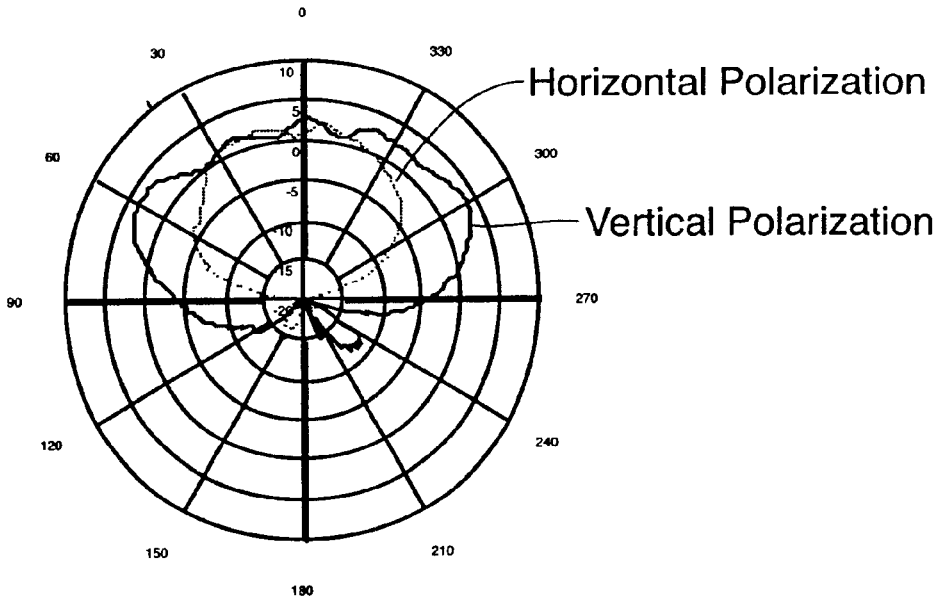
FIG. 5 shows the radiation pattern of a specific embodiment of the crossed slot antenna in linear polarization.
Figure 6:
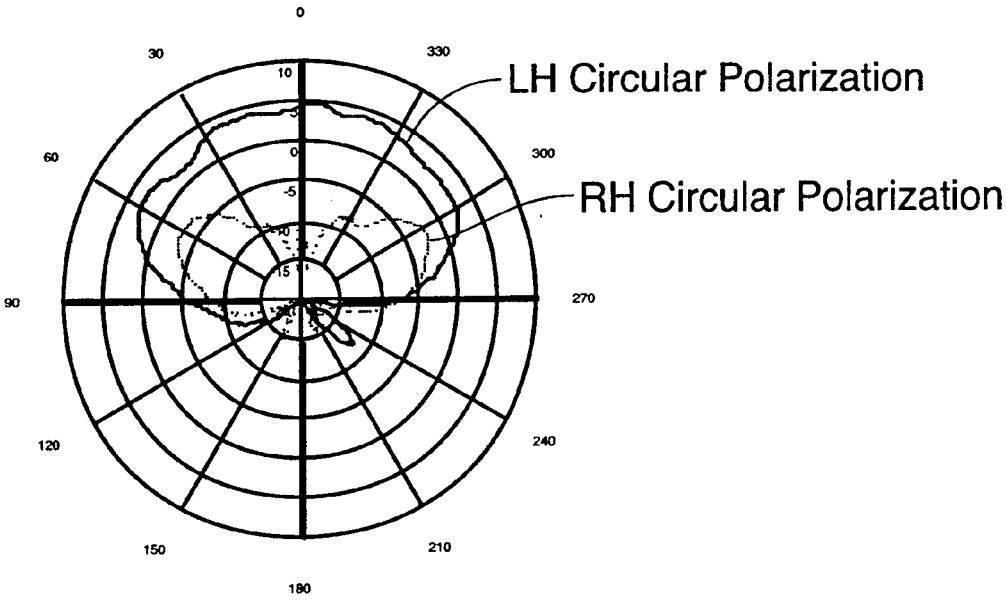
FIG. 6 shows the radiation pattern of the same antenna in circular polarization.

FIG. 5 shows the radiation pattern of the previously described specific embodiment of the crossed slot antenna in linear polarization. The radiation pattern of the vertical component is biased toward the horizon, and the crossed slot antenna achieves significant gain at low angles. FIG. 6 shows the radiation pattern of the same antenna in circular polarization. The antenna achieves significant gain in left-hand circular polarization over most of the upper hemisphere. Furthermore, right-hand circular polarization is significantly suppressed at high angles. An antenna designed for right-hand circular polarization would be obtained by making the antenna a mirror image of the antenna depicted by FIGS. 4*a* and 4*b*.

Figure 7A:
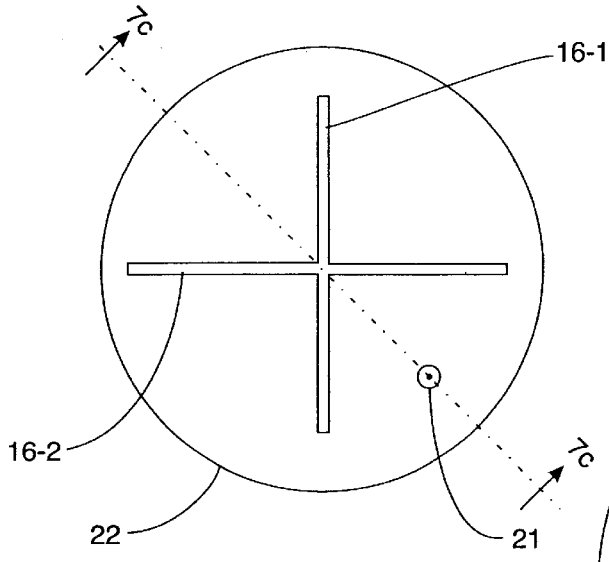
FIGS. 7*a*, 7*b* and 7*c*, depict an embodiment of the crossed slot antenna in an integrated antenna unit or package, FIG. 7*a* being a top plan view, FIG. 7*b* being a bottom view taken along line 7*b* shown in FIG. 7*c* and FIG. 7*c* being a cross section view taken along line 7*c* shown in FIGS. 7*a* and 7*b;*
Figure 7B:
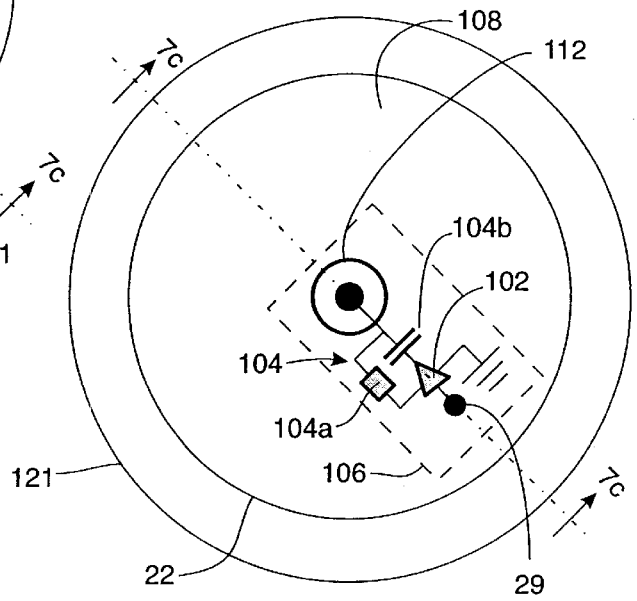
Figure 7C:
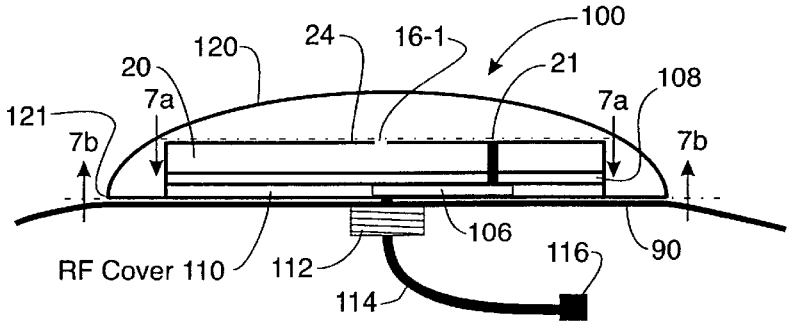

Having described the basic structure of the cavity-backed crossed-slot antenna with offset probe feed, an embodiment of the crossed slot antenna in the form of an integrated antenna unit 100 which can be easily installed on a vehicle will now be described. The integrated antenna unit or package 100 is shown in FIGS. 7*a*, 7*b* and 7*c*. The unit 100 preferably includes a crossed slot antenna with offset probe feed as previously described, a RF preamplifier 102 and bias circuit 104. The preamplifier 102 is preferably of a low noise type. The unit 100 also preferably includes a cover 108 that serves to connect the antenna's ground plane 26 (see FIG. 4*b*) to the surrounding metal 90 of the vehicle, as well as to protect the internal circuitry, provide RF shielding and to act as a support surface. The unit 100 also preferably includes a bracket 112 to aid in attachment to the vehicle 90, a cable 114, an RF connector 116, and a radome 120 to protect the entire structure 100 from the environment, to aid in styling, and to provide a more aerodynamic shape.

The antenna in the structure 100 has been described previously with respect to FIGS. 4*a* and 4*b* as including a crossed slot antenna, a cavity 20 (where the two slots 16-1, 16-2 are slightly detuned from one another to provide circular polarization), and a single offset probe feed 21. In order to overcome cable losses before the radio receiver, and the associated noise gain, it is desirable to include an integrated radio frequency preamplifier 102 in the antenna package 100. The same cable 114 through which the RF signal is drawn (or supplied) may supply a DC bias for this amplifier. This is accomplished using an appropriate bias circuit 104 consisting of an RF choke 104*a* and a DC blocking capacitor 104*b* in the case of a receiving embodiment. The circuit has a pad 29 for mating with the antenna feed point 21. This circuit may be built as an additional layer of circuit board material 106 on the crossed slot antenna cavity structure 24, which itself can be fabricated as a printed circuit board having an upper metal surface and a lower metal surface, with the slots 16-1, 16-2 being formed in the upper metal surface thereof and the lower metal surface thereof acting as the ground plane 26. Those skilled in the art of RF receiver design may well choose to include other RF components such as filters and multiple-stage amplifiers. The circuit lines shown in FIG. 7*b* on circuit board 106 are typically microstrip lines.

The cover 110 shown in FIG. 7*c* is a metal plate that may be made using metal stamping, which is placed over the circuitry and electrically connected to the antenna ground. The purpose of the metal cover is to provide RF shielding to the circuitry, and also to extend the antenna ground so that it is in close proximity to the metal exterior of the vehicle. This cover 110 may also be shaped to conform to the vehicle surface. A bracket 112 for attachment to the vehicle may be a scored or threaded metal cylinder upon which a snap ring or nut (not shown) may be applied to retain unit 100 in place on the vehicle. The bracket 112 is inserted through a hole in the vehicle exterior 90, and the matching ring or nut is applied from the other side. An antenna cable 114 extends through the circular bracket and the hole in the vehicle, and is terminated with a RF connector 116.

The unit 100 includes a radome structure 120 which surrounds the top of the unit 100 and provides protection from the environment, as well as helping aerodynamic and styling considerations. The radome 120 may either be solid dielectric, such as injection molded plastic, or it may be a hollow dielectric shell. It may also be painted to match the vehicle exterior.

Figure 7D:
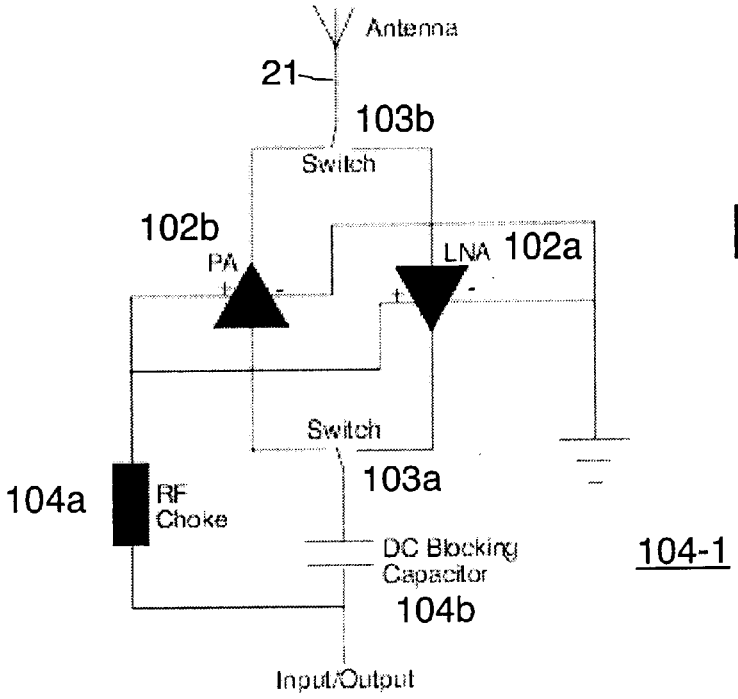
FIG. 7*d* is a circuit diagram of a antenna switch with power amplifier and preamplifier for connecting a crossed slot antenna to a transmitter/receiver.

Circuits 102 and 104 are intended to be used in a receiver embodiment; however, the crossed slot antenna can be used with both receivers and/or transmitters. The circuitry 104-1 of FIG. 7*d* can be used in place of circuits 102 and 104 in a transmitter/receiver embodiment. A power amplifier 102*b* is used in a transmit mode and is labeled PA. A low noise preamplifier 102*a* is used in a receive mode and is labeled LNA. Switches 103*a*, 103*b* are used to isolate these components during transmit/receive cycles. A DC blocking capacitor 104*b* and a RF choke 104*a* are used to isolate the DC power and the RF signals. Additional switches may be used to turn the amplifiers on or off, as needed. Microstrip lines are preferably used to interconnect these components as shown in FIG. 7*d*.

Figure 7E:
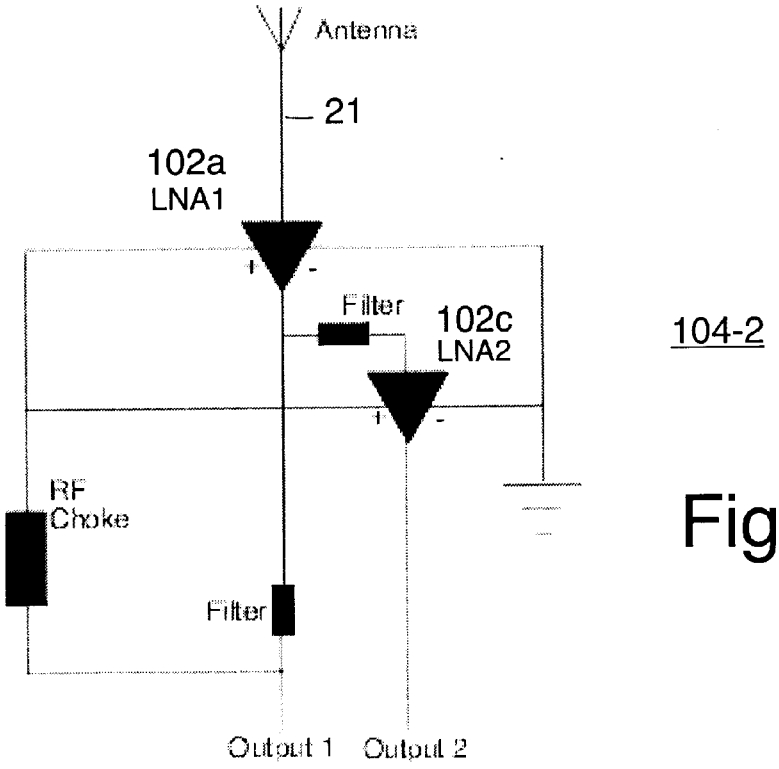
FIG. 7*e* is a circuit diagram of a circuit which may be used to connect a crossed slot antenna to direct broadcast receivers having dual inputs.

A microstrip is a popular transmission line for RF circuits. However, to feed the crossed slot antenna directly, a microstrip internal to the cavity would require an additional circuit layer inside the cavity 20, which would add cost. Given the additional cost, the techniques shown in the figures and described herein are presently preferred. However, some practicing the present invention may prefer to use a microstrip feed. When used in conjunction with an amplifier circuit, a microstrip line would naturally be used for the amplifier. However, in FIG. 7*b* the amplifier circuit 104 is external to the cavity and feeds the antenna by way of the probe feed 21 described herein. This is also true for the alternative circuit designs shown in FIGS. 7*d* and 7*e*.

It is understood that others are having difficulty in developing a single antenna structure which can receive both the satellite and the terrestrial signal with different polarizations and that they are opting for two separate antennas. Such antenna system will have two separate outputs, one for the satellite signal and another for the terrestrial signal. If this becomes part of the industry specifications for direct broadcast satellite radio receivers, then circuits 102 and 104 may need to have two separate outputs—one for the satellite signal and one for the terrestrial signal—in order to conveniently connect to such receivers. One possible modification to circuits 102 and 104 is circuit 104-2, shown in FIG. 7*e*, which can be used to connect the crossed slot antenna disclosed herein to such dual input receivers. This circuit 104-2 uses two low noise preamplifiers 102*a* and 102*c* labeled LNA1 and LNA2, each of which is connected to a respective output 1 and 2. Those two outputs 1, 2 are connected by suitable coaxial cables to the aforementioned dual input receiver.

Figure 1:
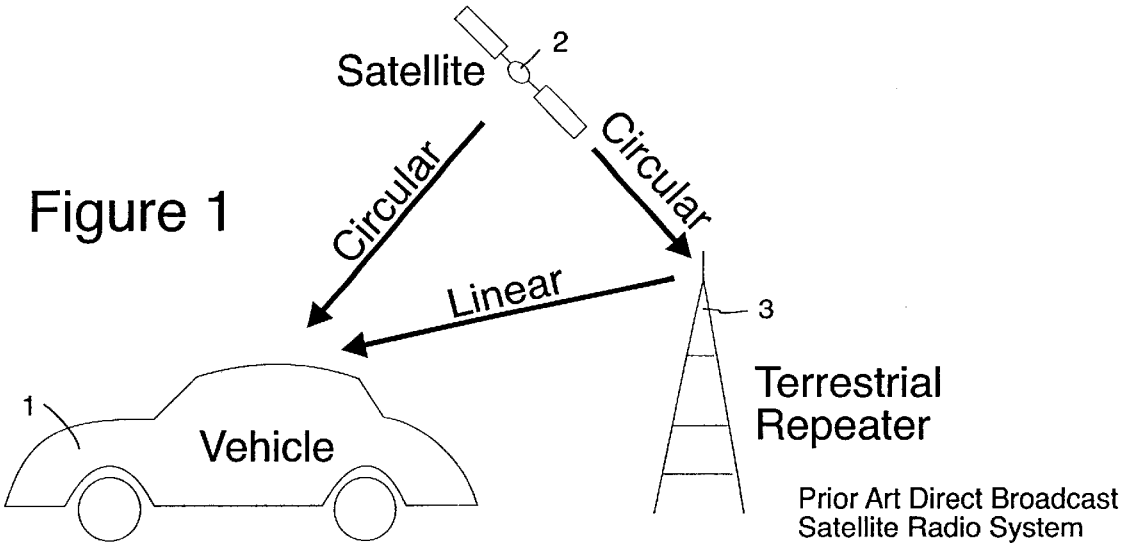
FIG. 1 is a schematic view of a direct broadcast satellite radio system.
Figure 8:
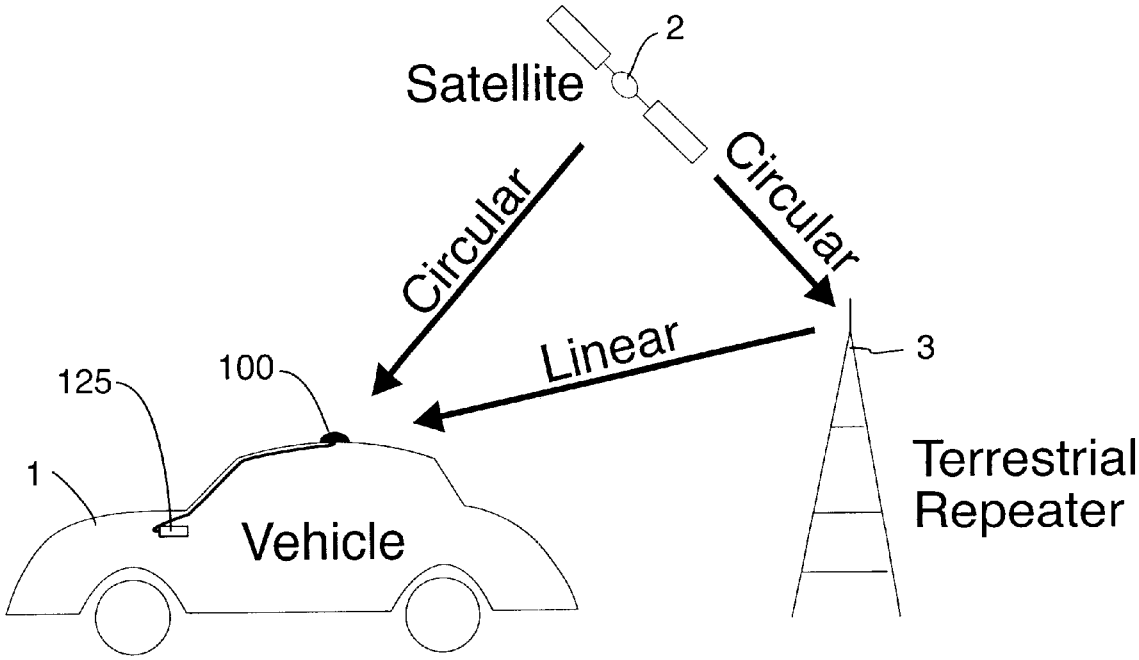
FIG. 8 shows the use of the integrated unit embodiment of a crossed slot antenna as disclosed herein in a direct broadcast satellite radio system.

FIG. 8 is similar to FIG. 1 but shows the use of this integrated antenna unit 100 on a vehicle 1 to receive direct broadcast satellite communications. The signals to be received originate at an orbiting satellite 2 and are transmitted to earth for reception by a receivers 125 in moving vehicles such as vehicle 1. The receiver 125 is mounted in the vehicle and is connected to antenna 100. A plurality of terrestrial base stations 3 receive the signals from the transmitter aboard satellite 2 and rebroadcast them at a different frequency. The frequencies of the direct broadcast signals from the satellite(s) and from the repeater(s) should fall within the bandwidth of the crossed slot antenna disclosed herein. The satellite broadcasts in circular polarization and the terrestrial repeater broadcasts in vertical linear polarization, but both are received by the same antenna unit 100 on the vehicle 1. The crossed slot antenna disclosed herein is ideal for this application because it is capable of receiving circular polarization from high angles and vertical linear polarization from low angles and can easily have sufficient bandwidth to receive both the circularly polarized signals and the vertically polarized signals.

Figure 9:
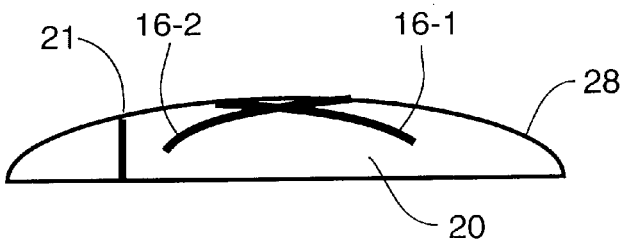
FIG. 9 shows an embodiment of a crossed slot antenna in which the cavity assumes a dome shape.

Additional variations of the crossed slot antenna will now be described FIG. 9 shows one aspect of this invention in which the cavity 20 forms a dome shape. This has the advantage of eliminating the curved radome 120, while maximizing the cavity volume for the smallest possible volume on the exterior of the vehicle. This embodiment may be built by forming the cavity 20 using injection molding of plastic and then metallizing the cavity 20 with a layer of metal 24 and etching the slots 16-1, 16-2 into it. A thin dielectric cover may then be applied to the entire structure to protect the slots from the environment. The slots 16-2, 16-2, when viewed in a plan view (similar to FIG. 10*a*) would appear to cross each other at a ninety degree angle.

The dome shaped structure is preferably formed by molding a suitable dielectric material in to dome shape depicted in FIG. 9 and then plating it with a conductive material such as copper.

To further reduce the volume on the exterior of the vehicle, the electronics may be included in a separate package, which is snapped or screwed onto the antenna on the interior side of the vehicle. By adding curvature and thickness to the crossed slot antenna, as is done according to the embodiment of FIG. 9, one may also improve its low angle radiation performance.

Figure 10A:
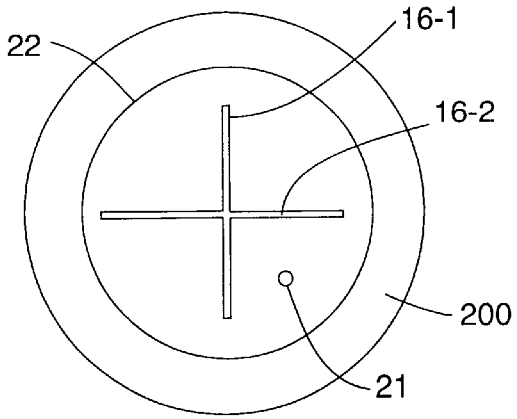
FIGS. 10*a* and 10*b* depict a parasitic ring structure which can be optionally used to improve low angle performance of the crossed slot antenna disclosed herein.
Figure 10B:
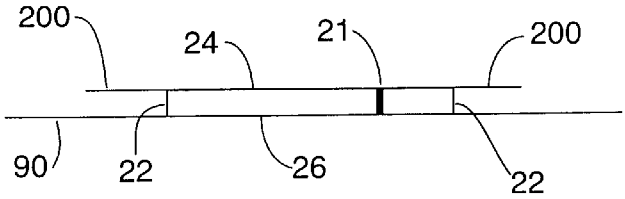

There are various other methods that may be employed to improved low angle performance. One of these is shown in FIGS. 10*a* and 10*b*. This is the use of an additional resonance structure 200 adjacent to the main antenna which is excited as a parasitic element. A resonant ring structure 200 shown in FIGS. 10*a* and 10*b*, which tends to direct the radiation from the antenna towards the horizon much like the parasitic directors of a Yagi-Uda antenna. Other parasitic structures may be employed for the same purpose, such as a region of high dielectric surrounding the main antenna, or other parasitic cavities or resonators.

FIGS. 10*a* and 10*b* show a parasitic director which is provided by the resonant ring structure 200. It is preferably made from metal and the metal ring 200 extends from the top edge of the slot antenna and overhangs the bottom surface 26.

Figure 10C:
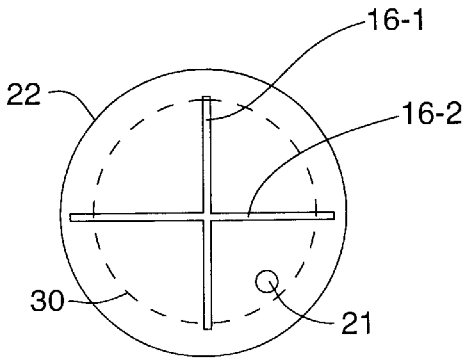
FIGS. 10*c* and 10*d* depict a pedestal structure which can be optionally used to improve low angle performance of the crossed slot antenna disclosed herein.
Figure 10D:
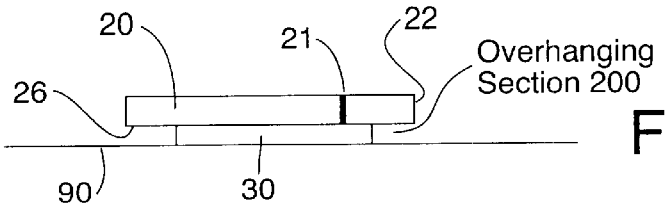

FIGS. 10*c* and 10*d* depict yet another technique for improving low angle performance of the disclosed crossed slot antenna to vertically polarized signals. This embodiment is related to the parasitic ring geometry of FIGS. 10*a* and 10*b*, except that the antenna is raised by a small amount above ground plane 90 on a pedestal 30, which may contain preamplifier circuits such as circuits 104, 104-1, or 104-2 previously described. The overhang region, as well as the slight increase in height, tends to increase the radiation toward the horizon. The embodiment of FIGS. 10*a* and 10*b* and the embodiment of FIGS. 10*c* and 10*d* both show a parasitic director. In the embodiment of FIGS. 10*a* and 10*b* the parasitic director is formed by an overhanging ledge of metal 200. In the embodiment of FIGS. 10*c* and 10*d* the parasitic director is formed by the cavity itself overhanging the smaller diameter pedestal 30 at numeral 200.

Figure 11:
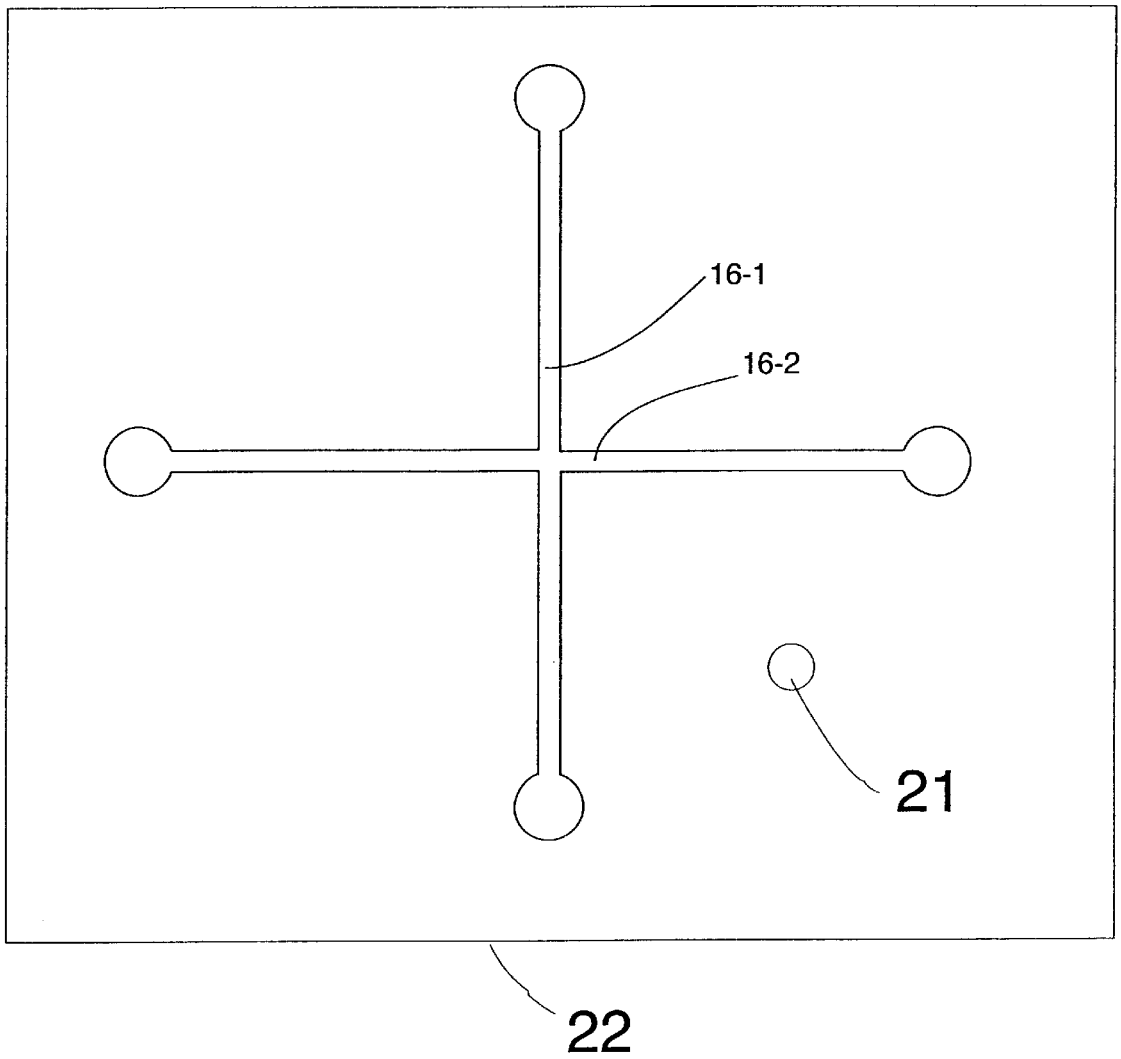
FIG. 11 is a plan view of a crossed slot antenna with bulbus or enlarged slot ends.

FIG. 11 shows a feature from a prior art patent (U.S. Pat. No. 5,581,266). This patent suggests the use of a bulb-like expansion 16-5 at the ends of the slots to improve the antenna bandwidth. The patent also suggests the use of vias to form the cavity which feature could be adapted for use with the present invention.

In the embodiments utilizing cross slots, the slots are defined as crossing each other at a ninety degree angle. Of course, the angle can be varied somewhat, but such variation is not preferred since it should tend to degrade the ability of the antenna to receive (or transmit) circularly polarized radio frequency signals. As such, while it is preferred that the slots cross each other at exactly a ninety degree angle, they should certainly cross each other within a range of 85 to 95 degrees.

Having described the invention in connection with a number of embodiments thereof, modification will now likely suggest itself to those skilled in the art. As such the invention is not to be limited to the disclosed embodiment expect as required by the appended claims.

What is claimed is:

1. A crossed slot antenna having a resonance frequency, said antenna comprising:

(a) an electrically conductive structure defining a cavity therein;

(b) first and second slots formed in said electrically conductive structure, said slots having different lengths such that said one slot has a resonance frequency above the resonance frequency of the antenna and such that said second slot has a resonance frequency below the resonance frequency of the antenna; and (c) a common feed point arranged to couple a radio frequency signal from the slots to said common feed point.

2. The crossed slot antenna of claim 1 wherein the cavity in said structure is at least partially filled with a solid dielectric material.

3. The crossed slot antenna of claim 1 wherein the cavity in said structure is completely filled with a solid dielectric material.

4. The crossed slot antenna of claim 1 wherein the structure has two major opposed surfaces, the slots being formed in a first one of said surfaces, the two surfaces being spaced from each other by a distance which is less than five percent of a wavelength of the resonance frequency of said antenna.

5. The crossed slot antenna of claim 4 wherein the two surfaces are spaced from each other by a distance which is less than 2.5% of a wavelength of the resonance frequency of said antenna.

6. The crossed slot antenna of claim 1 wherein the slots intersect each other at the center point of each slot along its length.

7. The crossed slot antenna of claim 1 wherein the feed point is spaced from each slot by a distance selected such the impedance of the feed point is essentially the same for each slot.

8. The crossed slot antenna of claim 7 wherein the feed point is spaced from each slot such that the feed point is disposed on a line which bisects the first and second slots.

9. The crossed slot antenna of claim 1 wherein the feed point is spaced from each slot such that the feed point is disposed on or immediately adjacent a line which bisects the first and second slots.

10. The crossed slot antenna of claim 1 disposed on an upward facing metal surface of a vehicle wherein the electrically conductive structure is electrically coupled to said upward facing metal surface.

11. The crossed slot antenna of claim 1 further including a radiation director assembly fixed thereto for increasing the sensitivity of the antenna to linearly polarized radio frequency radiation.

12. A method of fabricating a crossed slot antenna comprising:

(a) forming a cavity using a printed circuit board plated with metal on opposed surfaces;

(b) forming two slots in said plated metal, said slots having different lengths and intersecting each other at approximately a 90 degree angle; and (c) forming a metal plated via in said printed circuit board, said metal plated via defining a common feed point for said slots.

13. The method of claim 12 wherein the metal plated via is located on a line which bisects said slots.

14. The method of claim 12 wherein the metal plated via is located adjacent a line which bisects said slots.

15. The method of claim 12 wherein the crossed slot antenna has a resonance frequency and wherein the slots each having a resonance frequency, the resonance frequency of the one slot being above the resonance frequency of the antenna and the resonance frequency of the other slot being below the resonance frequency of the antenna.

16. The method of claim 12 further including:

(d) forming a printed circuit board with a preamplifier circuit mounted thereon;

(e) attaching the printed circuit board formed in step (d) to the cavity formed in step (a) so that the via formed in step (c) is coupled to the preamplifier circuit to conduct radio frequency signals from the slots formed in step (b) to said preamplifier circuit.

17. The method of claim 16 wherein the printed circuit board formed in step (d) has a mounting bracket installed thereon.

18. The method of claim 17 further including a step of attaching a coaxial cable to the circuit board formed in step (d) so that the cable is coupled to the preamplifier circuit to conduct radio frequency signals from the slots formed in step (b) externally of said antenna by way of said cable.

19. The method of claim 18 further including a step of installing a bias circuit on the printed circuit board formed in step (d), the bias circuit being connected to the cable and providing DC to said preamplifier circuit in response to receiving DC via said cable.

20. An antenna unit for mounting on a vehicle, the antenna unit comprising:

(a) a support surface and a mounting device for mounting the antenna unit on the vehicle;

(b) an antenna adapted for receiving circularly polarized radio frequency signals in at least directions oblique to said support surface, said antenna also adapted for receiving linearly radio frequency polarized signals;

(c) a protective cover covering said antenna; and (d) a circuit coupled to said antenna, said circuit capable of conducting said circularly polarized radio frequency signals and said linearly polarized radio frequency signals, wherein said antenna comprises a slot antenna having two slots, said slot antenna having a resonance frequency, said slots each having a resonance frequency, the resonance frequency of the one slot being above the resonance frequency of the antenna and the resonance frequency of the other slot being below the resonance frequency of the antenna.

21. The antenna unit of claim 20 wherein the slot antenna comprises a crossed slot antenna.

22. The antenna unit of claim 21 wherein the slot antenna includes a cavity having a first and second opposed conductive surfaces, the first surface having said slots formed therein which cross each other, when viewed in plan view, at a 90 degree angle.

23. The antenna unit of claim 22 wherein the first and second conductive surfaces are formed on exterior surfaces of a dielectric body.

24. The antenna unit of claim 23 wherein the first opposed conductive surface is dome shaped and the second opposed conductive surface is planar.

25. The antenna unit of claim 24 wherein the protective cover is formed directly on the first opposed conductive surface.

26. The antenna unit of claim 25 wherein the protective cover is colored to match said vehicle where the antenna unit mounts thereto.

27. The antenna unit of claim 23 wherein the first and second opposed conductive surfaces are planar and further including a peripheral conductive surface mating with the first and second opposed conductive surfaces.

28. The antenna unit of claim 27 wherein the protective cover is over and spaced from the first opposed conductive surface.

29. The antenna unit of claim 28 wherein the protective cover is a radome which is adapted to receive paint of a desired color.

30. The antenna unit of claim 22 wherein said circuit comprises a preamplifier circuit for amplifying radio frequency signals received by said slots and providing said signals to a single output, the preamplifier circuit being coupled to a feed point on said cavity which is spaced from said slots.

31. The antenna unit of claim 22 wherein said circuit comprises at least one preamplifier circuit for amplifying radio frequency signals received by said slots and providing said signals to a first and second outputs.

32. The antenna unit of claim 22 wherein said circuit comprises at least two preamplifier circuits for amplifying radio frequency signals received by said slots, a first preamplifier providing radio frequency signals corresponding to said circular polarization to said first output and a second preamplifier providing radio frequency signals corresponding to said linear polarization to said second output.

33. The antenna unit of claim 20 wherein the mounting device comprises a bracket which protrudes from the support surface.

34. The antenna unit of claim 20 wherein the protective cover is attached to said support surface.

35. The antenna unit as claimed in claim 20 wherein said circuit comprises a preamplifier circuit for amplifying radio frequency signals received by said slots and providing said signals to a single output, the preamplifier circuit being coupled to a feed point on said cavity which is spaced from said slots.

36. The antenna unit as claimed in claim 35 wherein said circuit further comprises a bias circuit connected to said preamplifier circuit.

37. A method of receiving circularly polarized radio frequency signals comprising:

(a) providing a slot antenna having two slots which cross each other in a surface of a cavity structure;

(b) varying the lengths of the slots so that the slots have different individual resonance frequencies; and (c) providing an antenna feed point on said surface which is spaced from both of said slots.

38. The method of claim 37 wherein the slot antenna has a resonance frequency and wherein the individual resonance frequencies of the slots differ from the resonance frequency of the slot antenna as a whole.

39. The method of claim 38 wherein the slots cross each other at a ninety degree angle.

40. The method of claim 37 wherein the feed point is located on or adjacent to a line which bisects the two slots.

41. A method of designing a crossed slot antenna capable of receiving both circularly polarized radio frequency signals and linearly polarized radio frequency signals, the crossed slot antenna having a pair of crossed slots formed in a surface of a cavity structure, said method comprising the steps of:

(a) calculating an effective dielectric constant in the slots of the crossed slot antenna that is the average of dielectric constant of the cavity and that of any radome or other environment located above the slots;

(b) calculating an effective index of refraction n, where $n=\sqrt{\in_{\text{average}}}$ and where $\in_{average}$=the dielectric constant calculated in step (a);

(c) determining an initially calculated average length of the slots of $\lambda/2n$ where $\lambda$=the wavelength of a desired resonance frequency of the crossed slot antenna;

(d) calculating an inherent bandwidth of the crossed slot antenna based on the formula $6\pi V/\lambda^3$ where V=the volume of the cavity structure;

(e) determining an initially calculated length of each slot by adding, for one slot, and subtracting, for the other slot, a distance equal to one-half of the inherent bandwidth, expressed as a percentage, of the antenna;

(f) adjusting the initially calculated length of each slot by experiment.

42. The method of claim 41 further including:

(g) determining an initially calculated location of a feed point as being located on a line which bisects the two slots and which is spaced a distance from each slot to yield a desired antenna impedance.

43. The method of claim 42 further including adjusting the initially calculated location of the feed point by experiment.

44. A method of fabricating a crossed slot antenna comprising:

(a) forming a cavity structure having conductive material on opposed surfaces thereof; and (b) forming two slots in said conductive material, said slots having different lengths and intersecting each other at or close to a 90 degree angle, wherein the crossed slot antenna has a resonance frequency and wherein the slots each have a resonance frequency, the resonance frequency of the one slot being above the resonance frequency of the antenna and the resonance frequency of the other slot being below the resonance frequency of the antenna.

45. The method of claim 44 further including the step of:

(c) forming a common feed point for said slots in said cavity structure.

46. The method of claim 45 wherein the common feed point is located on a line which bisects said slots.

47. The method of claim 45 wherein the common feed point is located adjacent a line which bisects said slots.

48. The method of claim 45 further including:

(d) forming a printed circuit board with a preamplifier circuit mounted thereon;

(e) attaching the printed circuit board formed in step (d) to the cavity structure formed in step (a) so that the feed point formed in step (c) is coupled to the preamplifier circuit to conduct radio frequency signals from the slots formed in step (b) to said preamplifier circuit.

49. The method of claim 48 wherein the printed circuit board formed in step (d) has a mounting bracket installed thereon.

50. The method of claim 49 further including a step of attaching a coaxial cable to the circuit board formed in step (d) so that the cable is coupled to the preamplifier circuit to conduct radio frequency signals from the slots formed in step (b) externally of said antenna by way of said cable.

51. The method of claim 50 further including a step of installing a bias circuit on the printed circuit board formed in step (d), the bias circuit being connected to the cable and providing DC to said preamplifier circuit in response to receiving DC by way of said cable.

52. A crossed slot antenna comprising:

(a) a cavity structure having conductive material on or forming opposed surfaces thereof; and (b) two slots in said conductive material, said slots having different lengths and intersecting each other at or close to a 90 degree angle, wherein the crossed slot antenna has a resonance frequency and wherein the slots each have a resonance frequency, the resonance frequency of one slot being above the resonance frequency of the antenna and the resonance frequency of the other slot being below the resonance frequency of the antenna.

53. The crossed slot antenna of claim 52 further comprising:

(c) a common feed point for said slots in said cavity.

54. The crossed slot antenna of claim 53 wherein the common feed point is located on a line which bisects said slots.

55. The crossed slot antenna of claim 53 wherein the common feed point is located adjacent a line which bisects said slots.

56. The crossed slot antenna of claim 53 further including a printed circuit board with a preamplifier circuit mounted thereon, wherein the printed circuit board is attached to the cavity structure so that the feed point is coupled to the preamplifier circuit to conduct radio frequency signals from the slots to the preamplifier circuit.

57. The crossed slot antenna of claim 56 wherein the printed circuit board has a mounting bracket installed thereon.

58. The crossed slot antenna of claim 57 including a coaxial cable mated to the circuit board so that the cable is coupled to the preamplifier circuit to conduct radio frequency signals from the slots externally of said antenna by way of said cable.

59. The crossed slot antenna of claim 58 further including a bias circuit disposed on the printed circuit board, the bias circuit being connected to the cable and providing DC to said preamplifier circuit in response to receiving DC by way of said cable.

60. A slot antenna comprising:

(a) a cavity structure having conductive material on or forming opposed surfaces thereof;

(b) at least one slot in the conductive material on a first surface of the cavity structure; and (c) a feed structure consisting of only a single feed point for said slot, the feed point being disposed in and penetrating said cavity structure, said feed point being coupled to said first surface at a point thereon which is spaced from said slot.

61. A crossed slot antenna for receiving or transmitting circularly polarized signals or linearly polarized signals comprising:

an electrically conductive structure defining a cavity therein;

first and second slots formed in said electrically conductive structure, said slots having different lengths; and a circuit coupled to said first and second slots, said circuit capable of conducting both said circularly polarized signals and linearly polarized signals, wherein the crossed slot antenna has a resonance frequency and wherein the slots each have a resonance frequency, the resonance frequency of one slot being above the resonance frequency of the antenna and the resonance frequency of the other slot being below the resonance frequency of the antenna.

62. The crossed slot antenna of claim 61 further comprising a common feed point for coupling said circuit to said slots, said common feed point being spaced from each slot.

63. A method of transceiving circularly polarized signals and linearly polarized signals comprising the steps of:

defining a cavity in an electrically conductive structure;

forming two slots in said electrically conductive structure, wherein the two slots each have a different length and each have a different resonance frequency; and coupling a circuit to said slots, said circuit capable of conducting both said circulary polarized and linearly polarized signals.

64. The method of claim 63 wherein the step of coupling said circuit comprises the step of forming a common feed point in said electrically conductive structure, said common feed point providing an electrical path from said slots to said circuit.

* * * * *